US012286802B2

(12) United States Patent
Sin

(10) Patent No.: US 12,286,802 B2
(45) Date of Patent: Apr. 29, 2025

(54) CONNECTING DEVICE FOR A LEG PART AND A BEAM

(71) Applicant: YongRak Sin, Busan (KR)

(72) Inventor: YongRak Sin, Busan (KR)

( * ) Notice: Subject to any disclaimer, the term of this patent is extended or adjusted under 35 U.S.C. 154(b) by 936 days.

(21) Appl. No.: 17/370,129

(22) Filed: Jul. 8, 2021

(65) Prior Publication Data

US 2023/0008155 A1 Jan. 12, 2023

(51) Int. Cl.

| | |
|---|---|
| ***E04G 1/15*** | (2006.01) |
| ***E04G 1/32*** | (2006.01) |
| ***E04G 1/34*** | (2006.01) |

(52) U.S. Cl.

CPC ..... *E04G 1/15* (2013.01); *E04G 1/32* (2013.01); *E04G 1/34* (2013.01); *E04G 2001/158* (2013.01)

(58) Field of Classification Search

CPC .... E04G 1/15; E04G 1/32; E04G 1/34; E04G 2001/158; B25H 1/06; E06C 7/50

See application file for complete search history.

(56) References Cited

FOREIGN PATENT DOCUMENTS

KR 10-2012-0057868 A 6/2012

*Primary Examiner* — Patrick J Maestri

(74) *Attorney, Agent, or Firm* — Goldilocks Zone IP LAW

(57) ABSTRACT

The present invention relates to a connecting device for a leg part and a supporting member, i.e., a beam, and more specifically, it is possible to secure a pair of leg part more easily and robustly to the beam using a fixing bolt, and it also relates to a leg member and a beam member connecting device so that the volume can be reduced by folding the leg member under the beam member during storage.

2 Claims, 9 Drawing Sheets

CONNECTING DEVICE FOR A LEG PART AND A BEAM

FIELD

The present invention relates to a connecting device for a leg part and a supporting member, i.e., a beam, and more specifically, it is possible to secure a pair of leg part more easily and robustly to the beam using a fixing bolt, and it also relates to a leg member and a beam member connecting device so that the volume can be reduced by folding the leg member under the beam member during storage.

BACKGROUND

In general, a support structure composed of a leg part and a beam in which both ends are connected and supported to the leg part in a state located between the leg part is used in various ways throughout the industry.

That is, the support structure may include a leg part and beam may be used as a pedestal to support a worktable. It can also be used as a support means to support a swing, which is a ride, and can also be used as a blocking facility such as no access.

A connecting operation of the leg part and the beam is usually provided with two leg part in a pair in a "^" shape of the leg part, and it is configured by fixing the beam to the upper surface of the pair of leg parts in a fixed way to each other.

However, a conventional clamp connecting a leg part and a beam is impossible to adjust an angle of unfolding outwardly and folding inwardly of the leg part once the assembly is complete. In addition, when the device is stored, the beam and leg parts cannot be folded, so the volume cannot be reduced, which is impractical.

BACKGROUND DOCUMENT

[Patent Document] Document 1: Korea Patent No. 101299565, issued on Aug. 19, 2013.

DESCRIPTIONS

Problems to be Solved

Therefore, an object of the present invention to solve the above problems is to fasten the fixing unit to the beam using a fixing bolt in addition to pressing the pressing plate, so that even if the pressing of the pressing plate is released due to an external impact, a connecting device for the leg part and the beam can fix the leg part and the beam more firmly.

Another object of the present invention is to provide a connecting device for a leg part and a beam that can be fixed to the strong connection of the leg part and the beam to allow a pressing plate to press more strongly on both sides of the beam through the pressing bar during the unfolding operation of the leg part.

Summary

The present invention for achieving the above-described purposes, a connection device for connecting a pair of leg part to the beam, may include: a leg part connection frame, which is connected to each of the pair of leg parts, a fixing unit connected to the leg part connection frame and pressed to both outer surfaces of the beam and connecting the leg part connection frame to the beam; wherein the fixing unit includes a first plate hung on the upper end of the leg part connection frame; a second plate which is in close contact with the inner space of the leg part connection frame in a state inserted into the space of the leg part connection frame through the upper end of the leg part connection frame, and is located on the lower surface of the first plate at a predetermined distance apart; a pair of insertion parts formed in a "∩" shape configured to be inserted into a pair of inner spaces of the pair of leg part connection frames, wherein the pair of insertion parts includes, a pressing bar, which is a central round part exposed to the upper part of the first plate, and a straight part line part extended from the central round part thereof, positioned between the pair of the first and the pair of second plates in close contact with the inner spaces of pair of leg part connection frame, respectively; a pressing plate welded in contact with the round part of the pressing bar and configured to press the outer surfaces of both sides of the beam in accordance with an unfolding operation of the leg part connection frame outwardly; a connecting bolt, having a head hole, fixedly installed on the front and rear surfaces of the pressing plate; a hinge bolt having a head hole, configured to penetrate the head hole of the connecting bolt for the fixing unit is rotated in a left and/or a right direction; a hinge shaft for rotating the fixing unit in forward and backward directions is installed through the head hole of the hinge bolt, and the head hole of the fixing bolt is inserted into the outer diameter of the hinge shaft; and the fixing bolt is nut-fastened in a state of being inserted into a fastening groove formed at the lower end of the beam, and the fixing unit is connected to the lower end of the beam.

Aspect(s) of the present invention provides a foot plate made of a metal material having a higher strength than the beam, is fixed in a close contact state at the lower end of the beam in which the fastening groove is formed, a fastening hole is formed on the foot plate to communicate with the fastening groove, the fixing bolt is inserted into the fastening groove through the fastening hole.

Effect of the Invention

The present invention has an effect of more firmly fixing the leg part and the beam even if the pressing of the pressing plate is released due to an external impact by fastening the fixing unit to the beam using a fixing bolt in addition to pressing the pressing plate.

In addition, by installing the footplate between the beam of the wood material and the fixing unit of the metal material, it is possible to solve problems such as not being able to support the beam in parallel due to the misalignment of the unfolding angle of the leg part connected to the fixing unit.

During unfolding operation of the leg part, pressing plate may press more strongly on both sides of the beam through the pressing bar, so that the leg part and beam can be strongly connected and fixed.

DETAIL DESCRIPTION OF THE EMBODIMENT

Figure 1:
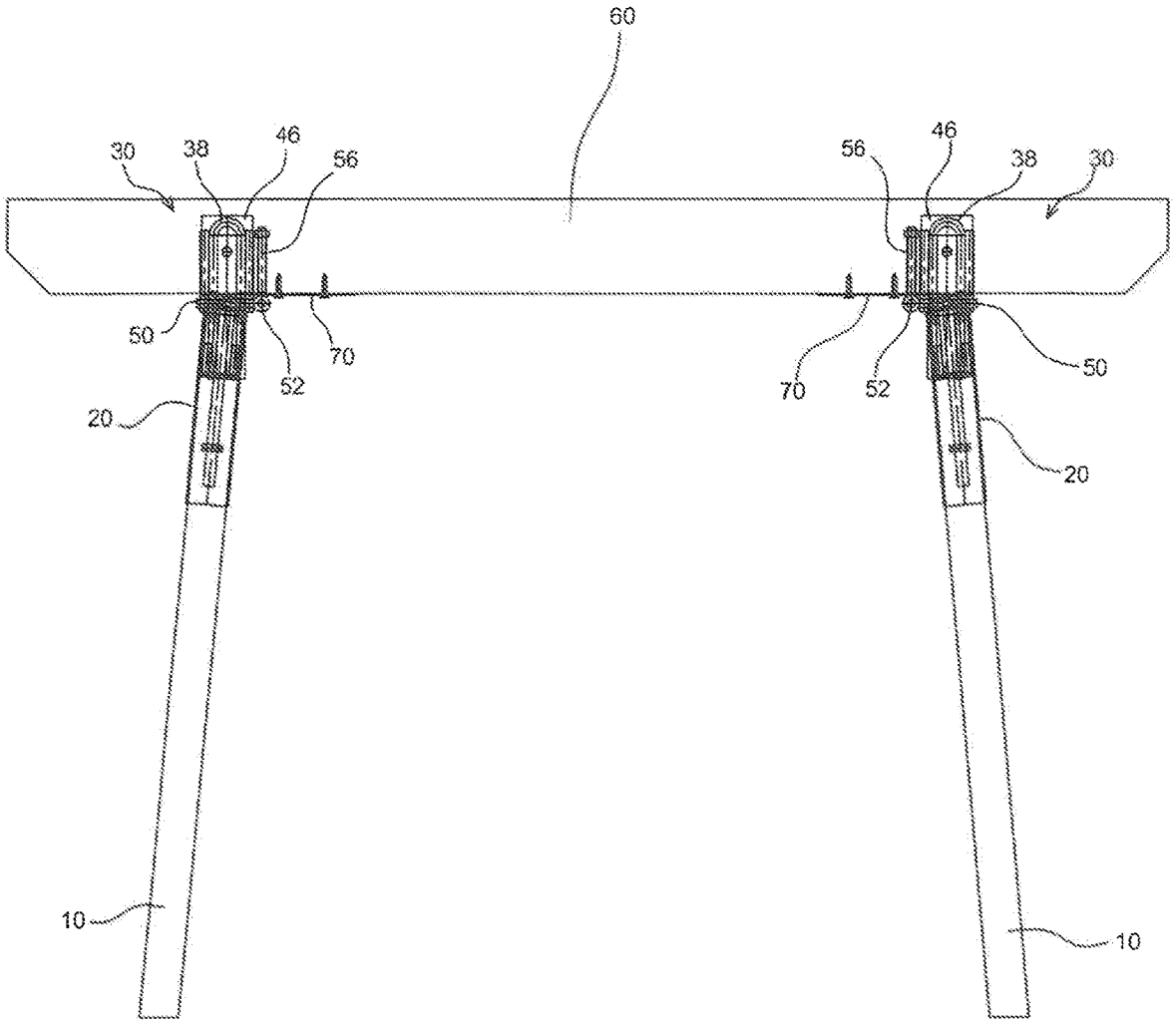
FIG. 1 is a view showing the entire configuration of a connecting device of the leg part and the beam according to an embodiment of the present invention.

It will be appreciated that for simplicity and clarity of illustration, where considered appropriate, reference numerals may be repeated among the figures to indicate corresponding or analogous elements or steps. In addition, numerous specific details are set forth to provide a thorough understanding of the exemplary embodiments described herein. However, it will be understood by those of ordinary skill in the art that the embodiments described herein may be practiced without these specific details, or with other methods, components, materials, etc. In other instances, well-known methods, procedures, and components have not been described in detail have not been shown or described in detail to avoid unnecessarily obscuring descriptions of the embodiments, and since these are known to those skilled in the art. Furthermore, it should be noted that this description is not intended to limit the scope of the embodiments described herein, but rather as merely describing one or more exemplary implementations.

Unless the context requires otherwise, throughout the specification and claims which follow, the word "comprise" and variations thereof, such as, "comprises" and "comprising" are to be construed in an open, inclusive sense, that is as "including, but not limited to."

It should be noted that terms of degree such as "substantially", "about" and "approximately" when used herein mean a reasonable amount of deviation of the modified term such that the result is not significantly changed. These terms of degree should be construed as including a deviation of the modified term if this deviation would not negate the meaning of the term it modifies.

Reference throughout this specification to "one implementation" or "an implementation" or "one embodiment" or "an embodiment" means that a particular feature, structures, or characteristics may be combined in any suitable manner in one or more implementations or one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

The headings and Abstract of the Disclosure provided herein are for convenience only and do not interpret the scope or meaning of the implementations or embodiments.

The terms "coupled" or "coupling" as used herein can have several different meanings depending in the context in which these terms are used. For example, the terms coupled or coupling may be used to indicate that an element or device can electrically, optically, or wirelessly send data to another element or device as well as receive data from another element or device.

Similarly, throughout this specification and the appended claims the term "communicative" as in "communicative pathway," "communicative coupling," and in variants such as "communicatively coupled," is generally used to refer to any engineered arrangement for transferring and/or exchanging information. Exemplary communicative pathways include, but are not limited to, electrically conductive pathways (e.g., electrically conductive wires, electrically conductive traces), magnetic pathways (e.g., magnetic media), optical pathways (e.g., optical fiber), electromagnetically radiative pathways (e.g., radio waves), or any combination thereof. Exemplary communicative couplings include, but are not limited to, electrical couplings, magnetic couplings, optical couplings, radio couplings, or any combination thereof.

Figure 2:
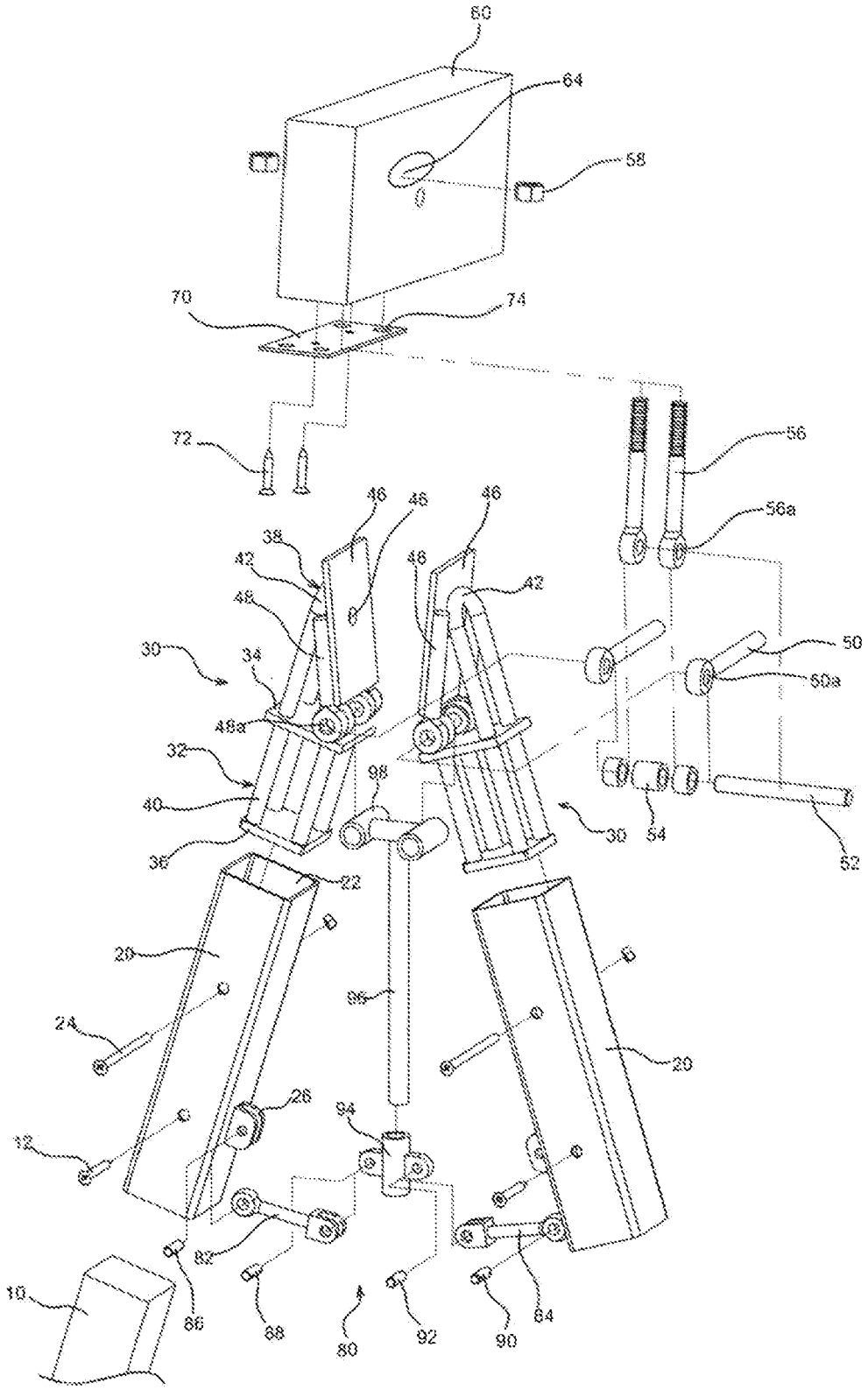
FIG. 2 is an exploded three-dimensional view showing an extract of the structure of the connecting device shown in FIG. 1.
Figure 3:
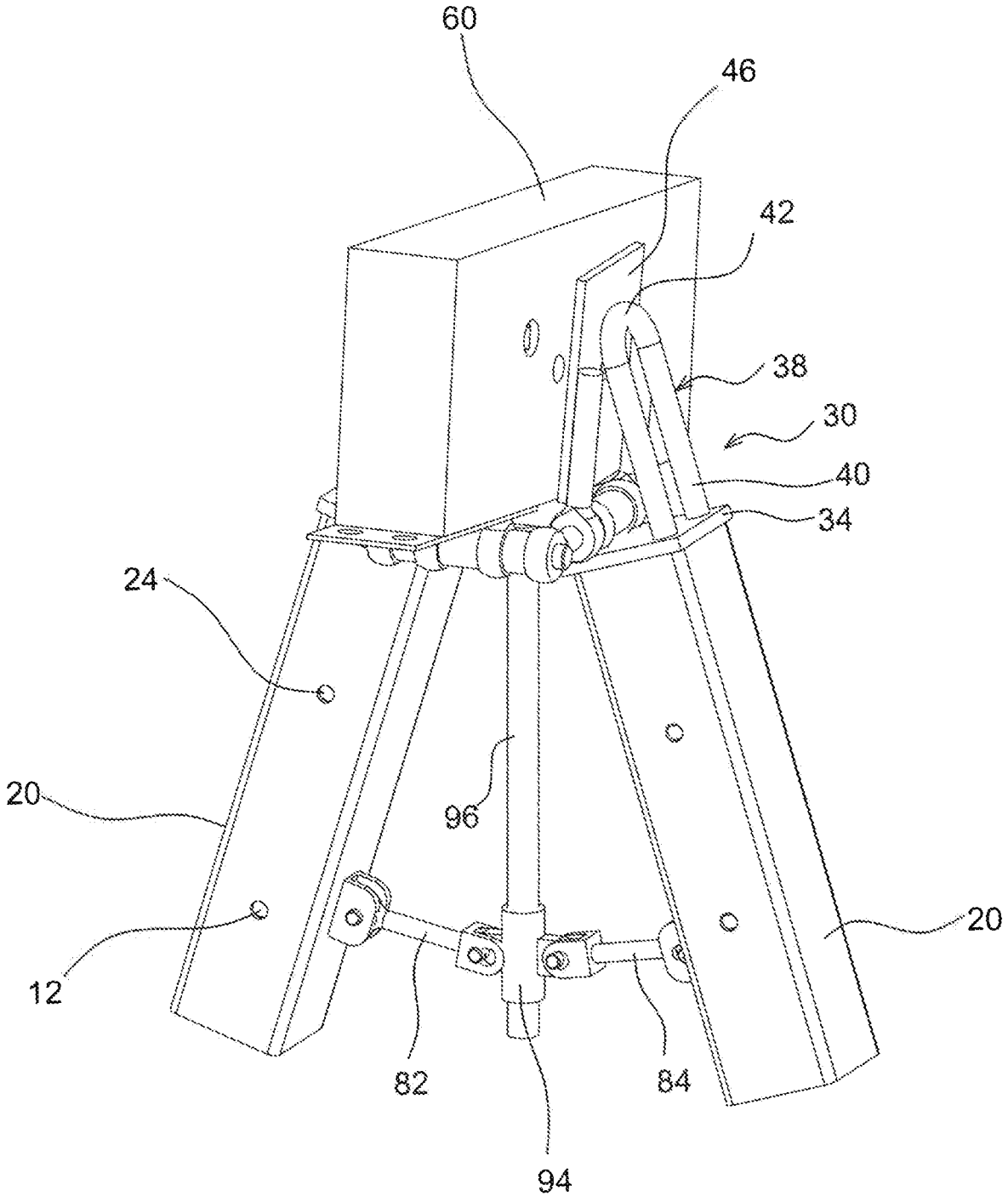
FIG. 3 is a combined three-dimensional view of FIG. 2.
Figure 4:
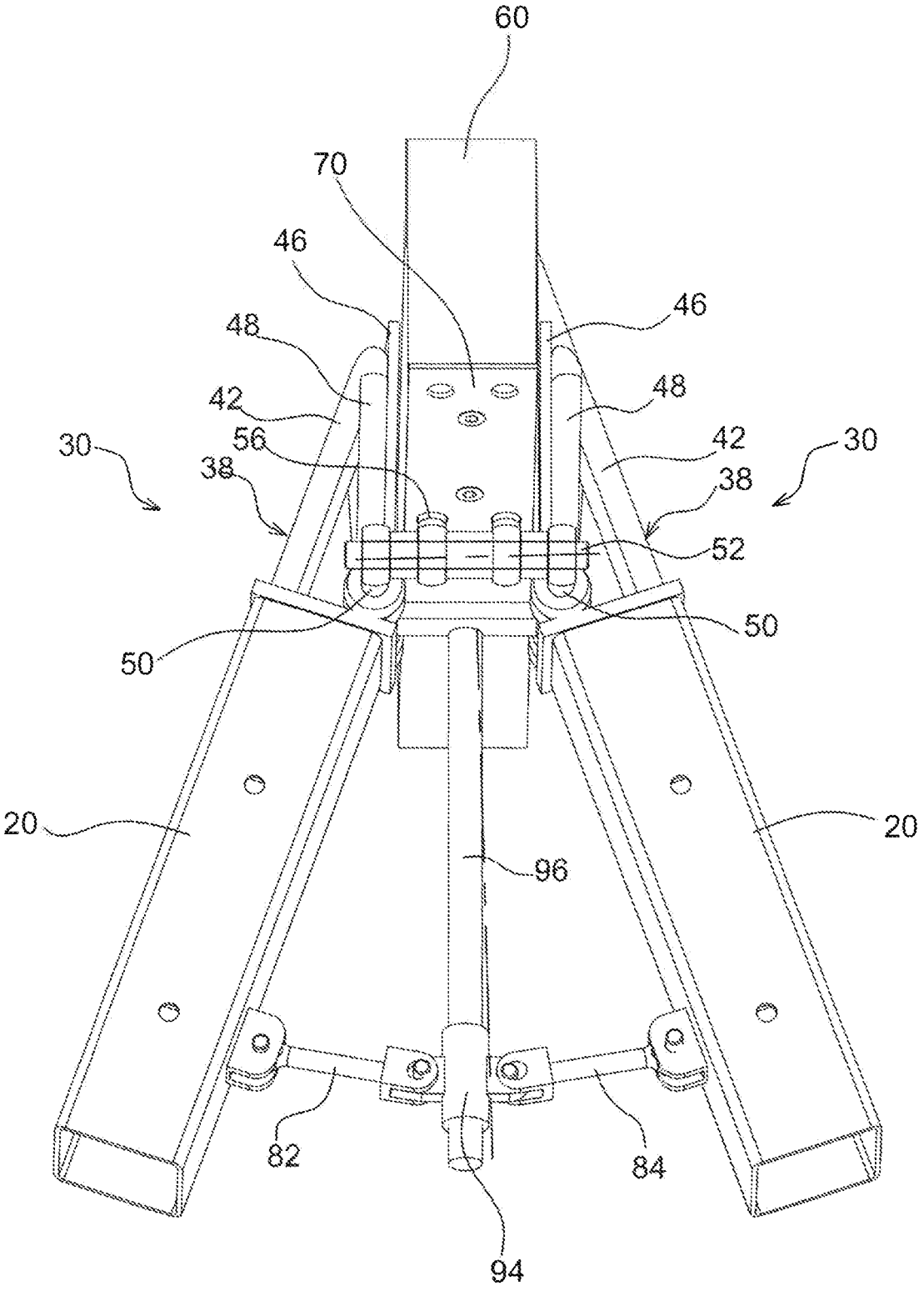
FIG. 4 is a bottom three-dimensional view of FIG. 3.
Figure 5:
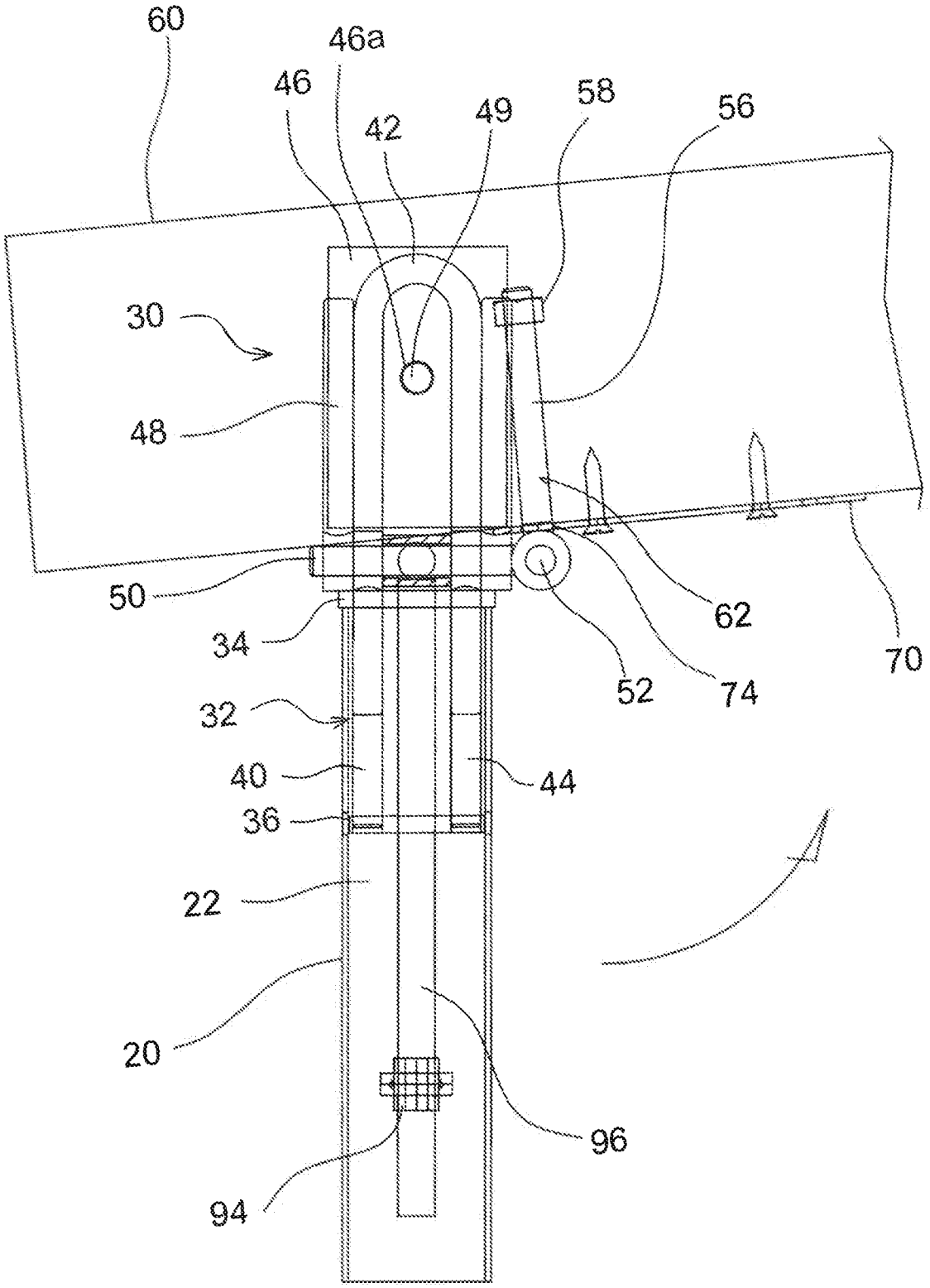
FIG. 5 is a side cross-sectional view of FIG. 2.
Figure 6:
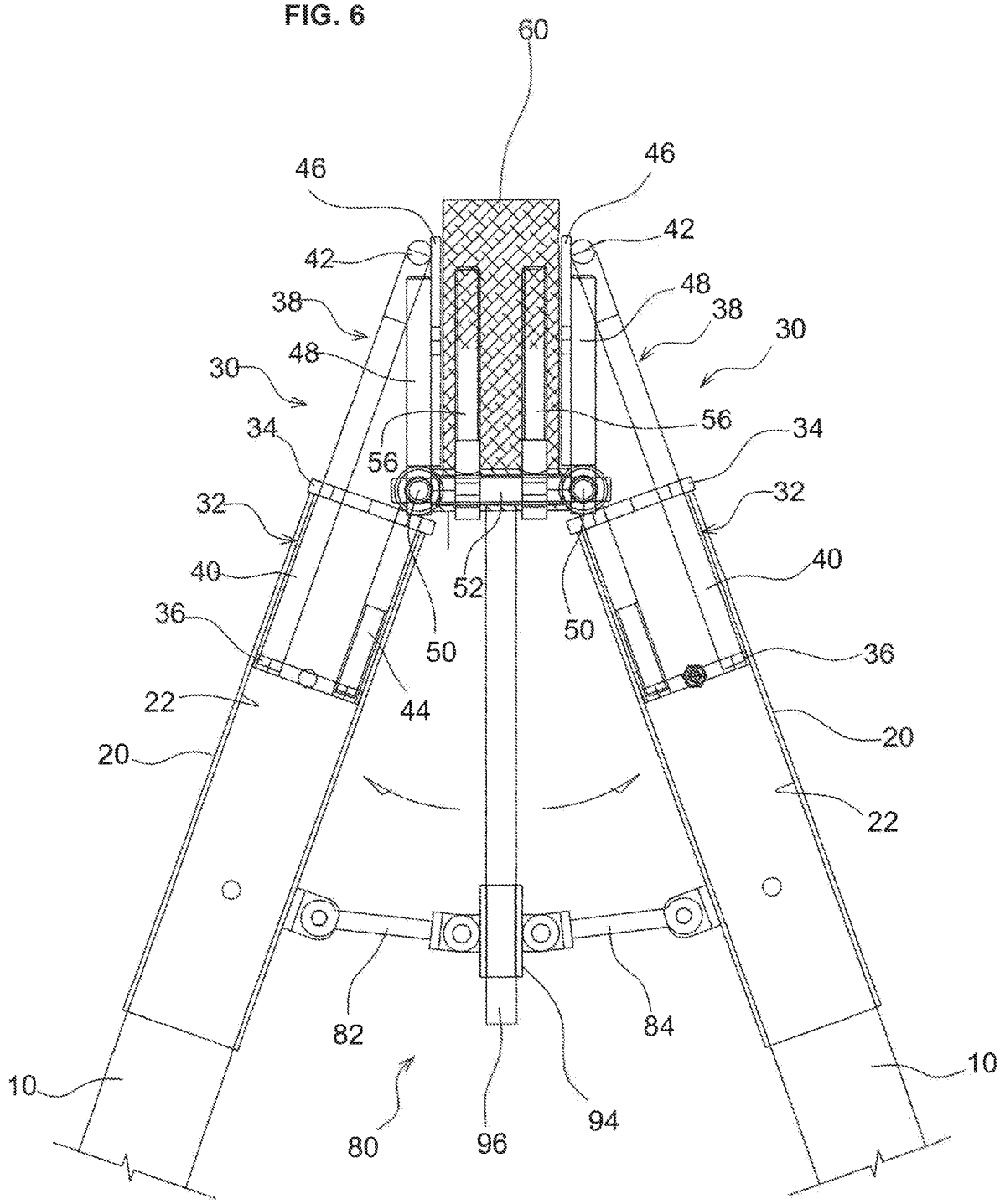
FIG. 6 is a front sectional view of FIG. 2.
Figure 7:
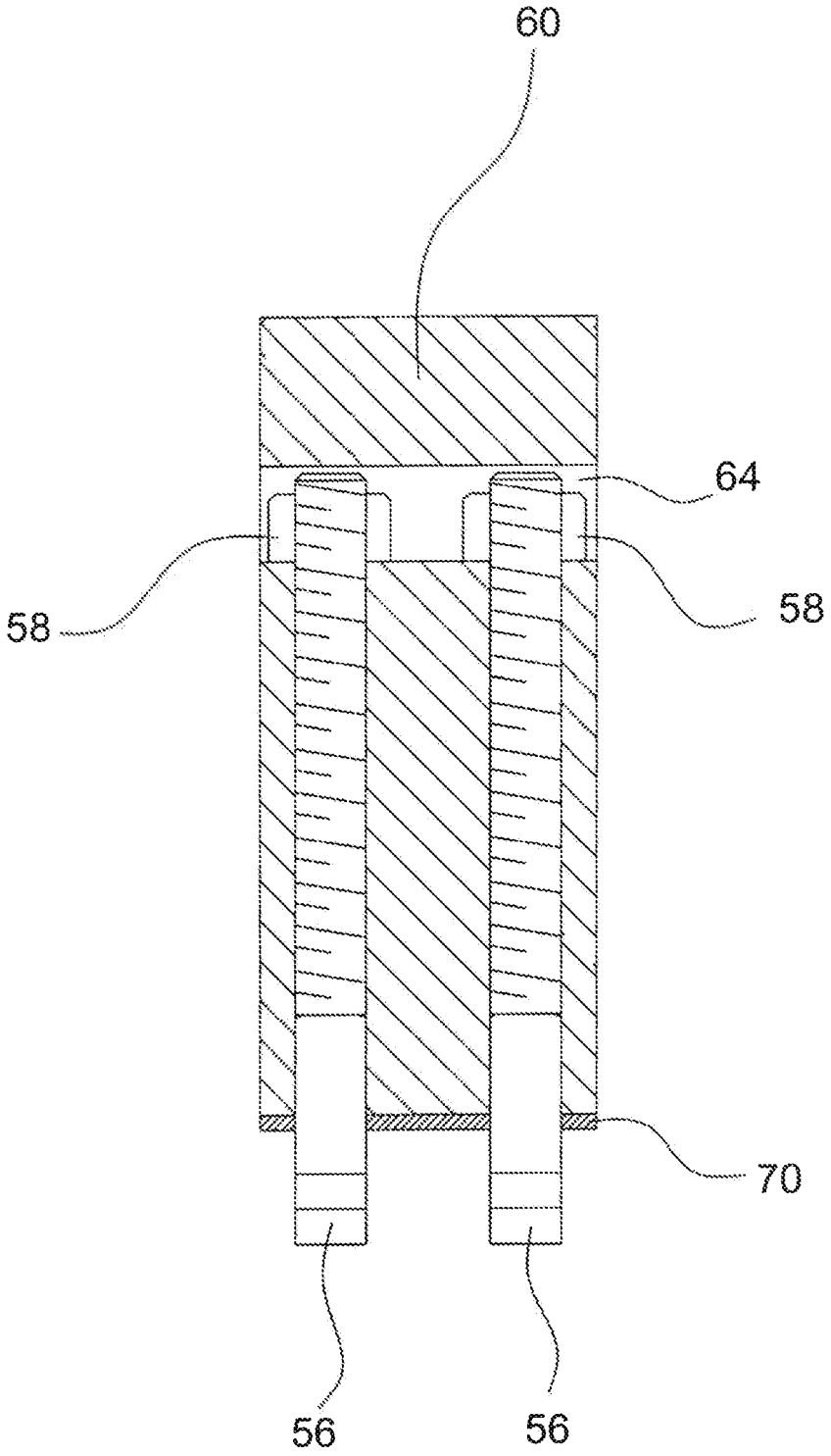
FIG. 7 is an excerption view of a beam and a footplate.
Figure 8:
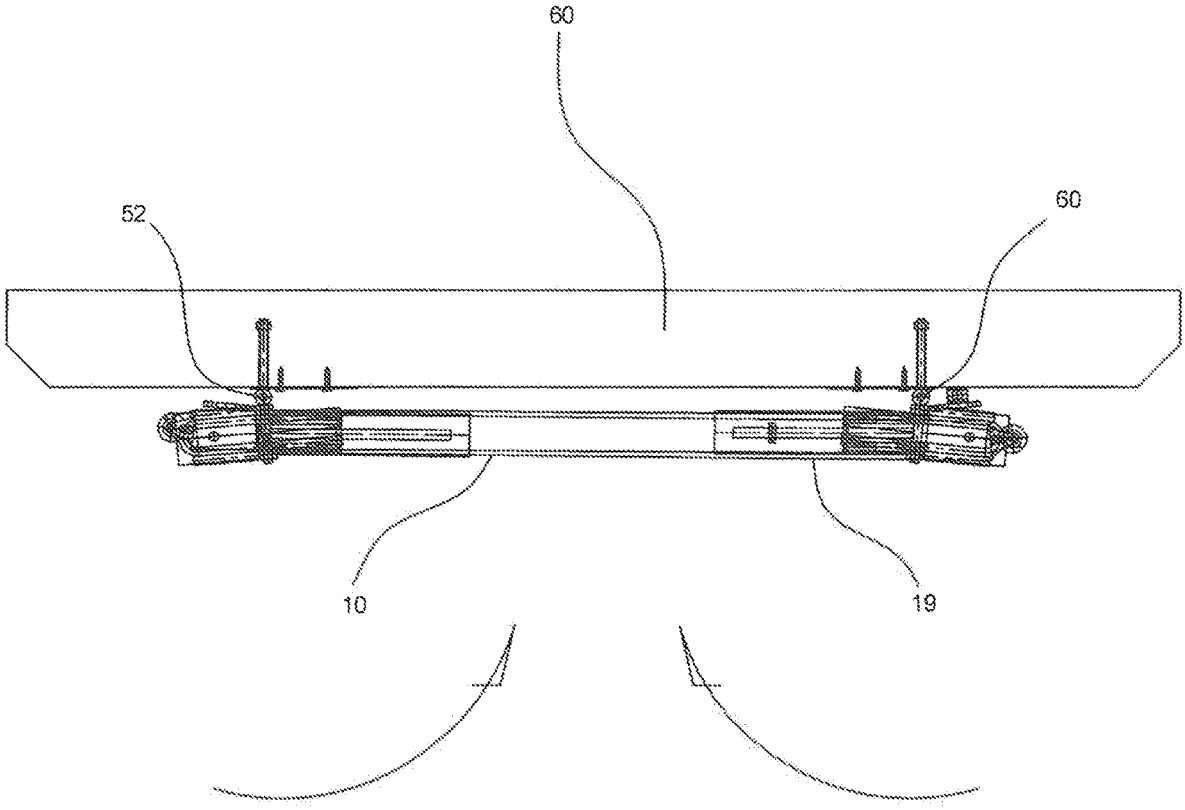
FIG. 8 is a view showing a state in which the leg part is folded under the beam.
Figure 9:
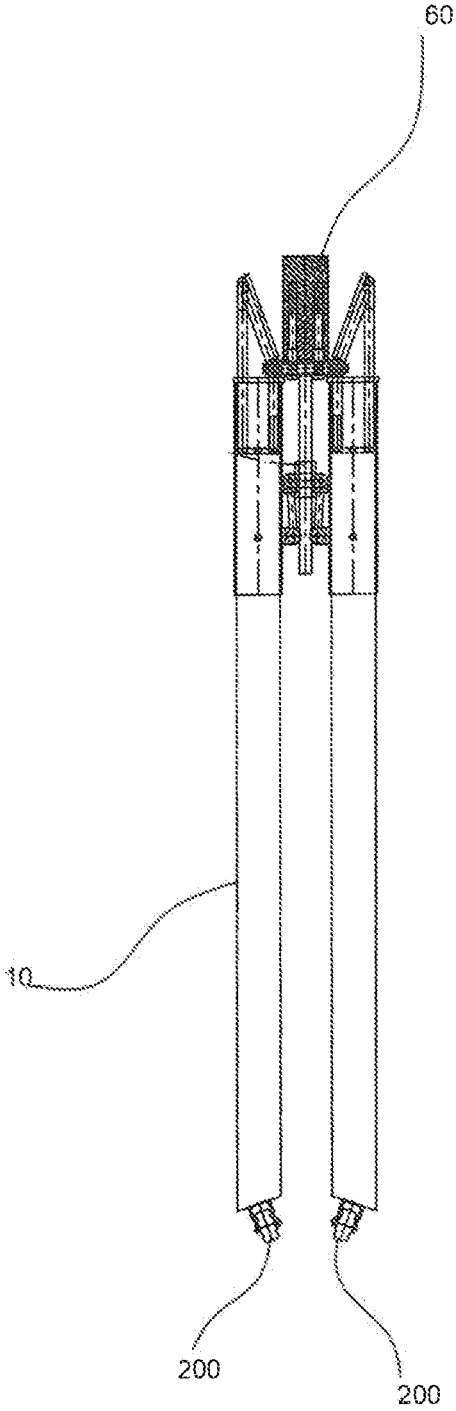
FIG. 9 is a view that shows the state in which the roller is installed at the bottom of the leg part.

FIG. 1 is a view showing the overall configuration of a connecting device of a leg part and a beam according to a preferred embodiment of the present invention, FIG. 2 is an exploded three-dimensional view showing the structure of the connecting device shown in FIG. 1 extracted, FIG. 3 is a combined stereoscopic view of FIG. 2, FIG. 4 is a bottom stereoscopic view of FIG. 3, FIG. 5 is a side sectional view of FIG. 2, FIG. 6 is a front sectional view of FIG. 2, FIG. 7 is an excerpt of a beam and a foot plate, FIG. 8 is a view showing a state in which a leg part is folded under a beam, and FIG. 9 is a view showing a state in which a roller is installed at the lower end of the leg part according to aspect(s) of the present invention.

FIGS. 1 to 9, a connecting device for the leg part and the beam may include a pair of leg parts 10, a pair of leg part connecting frame 20, a fixing unit 30, and a beam 60.

The leg part connecting frame 20 is used for connecting a pair of leg parts 10 to the beam 60, respectively.

The leg part connecting frame 20 has the leg part 10 installed detachably. The leg part connecting frame 20 has a rectangular pipe cross-sectional shape and a space 22 is formed therein, and with an end of the leg part 10 is partially inserted into the space 22, fastened, and fixed with the bolt 12.

The fixing unit 30 is configured to connect the beam 60 and the leg part 10 by pressing and fixing the leg part connection frame 20 connected to the leg part 10 to the beam 60.

The fixing unit 30 may include: an insertion part 32, which comprising a first and a second plates 34, 36, a pressing bar 38, and a connecting rod 44; and a pressing plate 46, located on the upper part of the insertion part 32, by pressing and fixing the leg part connection frame 20 to both outer surfaces of the beam 60, to connect the beam 60 and the pair of leg parts 10.

The insertion part 32 is a member inserted into the space 22 of the leg part connecting frame 20 through the upper part of the leg part connection frame 20. When the insertion part 32 of the fixing unit 30 is inserted into the space 22 of the leg part connection frame 20, the first plate 34 constituting the insertion part 32 is hung on the top of the leg part connection frame 20 and limits an insertion depth of the fixing unit 30.

The second plate 36 is located in a state a predetermined distance below the first plate 34 and is bonded to the end of the pressing bar 38 through the first plate 34.

The pressing bar 38 and the second plate 36 is inserted into the space 22 of the leg part connection frame 20 through the top of the leg part connection frame 20 is in closely contacted to the inside of the space 22.

The pressing bar 38 is a rod having an overall "∩" shape, and both ends of the straight portions 40 are welded to the outer corners of the second plate 36 while penetrating the first plate 34, respectively. The central round part 42 of the pressing bar 38 is configured to be welded to the outer surface of the pressing plate 46 in a state exposed to the upper surface of the first plate 34.

After both straight ends 40 of the pressing bar 38 are inserted into the space 22 of the leg part connection frame 20, they are in close contact with the inner surface of the space 22 together with the second plate 36.

At this time, the central round part 42 of the pressing bar 38 intensively presses an outer surface of the pressing plate 46 according to the outer unfolding operation of the leg part connection frame 20, and through this, the pressure plate 46 in contact with the both the outer surface sides of the beam 60 is effectively fixed in close contact.

A hole 46*a* is formed in the pressing plate 46, and a safety pin 49 is nut-fastened through the hole 46*a*. The safety pin 49 sequentially passes through the hole 46*a* of the pressing plate 46 and the hole 60*a* formed in the beam 60 and is nut-fastened. The connecting rod 44 is sandwiched between the first and second plates 34, 36 and is supported while maintaining a gap between the first and second plates 34, 36.

The pressing plate 46 is a flat plate type and is connected and fixed to the central round part 42 of the pressing bar 38 by welding while being mounted on the upper surface of the first plate 34. In a state in close contact with the outer surfaces of both sides of the beam 60, the pair of leg part connection frames 20 are connected and supported to the beam 60.

Connecting bolts 48 are attached to the front and rear surfaces of the pressing plate 46. A head hole 48*a* is formed in the connecting bolt 48, the hinge bolt 50 passes through the head hole 48*a*, the pressing plate 46 may rotate around the hinge bolt 50.

The fixing unit 30 provided with the pressing plate 46 rotates in the left and right directions with a hinge bolt 50 to be described later as a starting point and presses and adheres the pressing plate 46 to both outer surfaces of the beam 60.

In addition, the leg part 10 rotates against the hinge shaft 52 in the front and rear directions as a starting point and can be assembled to be folded under the beam 60, and a detailed description thereof will be described below. do.

An angle control part 80 is installed between the pair of leg part connection frame 20 and may guide unfolding outwardly and the folding inwardly of the leg part connection frame 20.

The first and the second link 82, 84 are links connecting a pair of leg part connection frame 20 to each other.

One end of the first link 82 is connected to one of bracket 26, which is installed on one side of the leg part connection frame 20, by a first pin 86 and the other end of the first link 82 is connected to the lift frame 94 by a second pin 88.

One end of the second link 84 is connected to another bracket 26, which is installed on the other side of the leg part connection frame 20, by a third pin 90 and the other end of the second link 84 is connected to the lift frame 94 by a fourth pin 92.

The lift frame 94 is located between the first, second link 82, 84, and is coupled to the first, second link 82, 84 and the lift frame 94 for connecting the first, the second link 82, 84 to each other by the second pin, the fourth pin 88, 92.

The first and second links 82, 84 are tilted with a first and a third pins 86, 90 as a starting point, i.e., the first and the third pins 86, 90 are hinge points, when the leg part connecting frame 20 is folded inwardly or opened outwardly. In the process, the lift frame coupled to the first and second links with the first and the third pins 86, 90 performs up and down vertical motions.

The guide bar 96 is located between the first and second links 82 and 84, and a connecting pipe 98 for connecting to the hinge bolt 50 for rotatably supporting the fixing unit 30 is formed at an end of the guide bar 96.

The lift frame 94 is fitted to an outer diameter of the guide bar 96, and thus the lift frame 94 is guided to move up and down along with the guide bar 96.

On the other hand, when connecting and fixing the leg part 10 to the beam 60 through the fixing unit 30, if excessive force or external impact is applied during use, the pressing force of the fixing unit 30 may be released and a connection between the leg part 10 and the beam 60 may be released.

In consideration of this, the fixing bolt 56 is connected to the hinge bolt 50 of the fixing unit 30 by the hinge shaft 52. By fastening the nut 58 in a state in which the fixing bolt 56 is inserted into the fastening groove 62 formed at the lower end of the beam 60, in addition to the pressing force of the fixing unit 30, the leg part 10 can be firmly fixed to the beam 60 without shaking through the fastening of the fixing bolt 56 and the nut 58.

In addition to the pressing force of the fixing part 30, the leg part 10 can be firmly fixed to the beam 60 without being shaken through the fastening of the fixing bolt 56 and the nut 58, the fixing bolt 56 may fix the nut 58 while being inserted into the fastening groove 62 formed at the lower end of the beam 60.

Here, the hinge bolt 50 is inserted into the second head hole 48*a* of the connecting bolt 48 of the fixing unit 30, and the fixing unit 30 is rotated in a left and a right direction to rotate the pressing plate 46 to be pressed into contact with the outer surfaces of both sides of the beam 60.

And the hinge shaft 52 is fitted into a third head hole 50*a* of the hinge bolt 50 and allows the fixing unit 30 to rotate forward and backward, so that the leg part 10 when storing the device as shown in FIG. 8 is folded under the beam 20 to reduce the volume so that it can be stored.

In addition, it is also possible to easily implement the movement of the device by installing a roller 200 at the bottom of the leg part 10, as shown in FIG. 9 of another embodiment of the present invention.

On the other hand, according to an aspect of the present invention, using a fixing bolt 56, even if the folding pressure of the fixing unit 30 unintentionally terminated, by continuously maintaining the fixation between the beam 60 and the leg part 10 can proceed with a more stable operation.

Below will be described in more detail the connection structures between the fixing bolt 56 and the fixing unit 30, and the fixing bolt 56 and beam 60, respectively.

For the connection between the fixing bolt 56 and the fixing unit 30, the hinge shaft 52 passes through the third head hole 50*a* formed at the tip of the hinge bolt 50, the hinge bolt 50 is passed through the head hole 48*a* provided in the connecting bolt 48 of the fixing unit 30, a guide ring 54 for preventing play of the hinge bolt 50 is inserted between the third head holes 50*a* of the hinge bolt 50.

And the hinge shaft 52 passes through a fourth head hole 56*a* formed in the head of the fixing bolt 56 in a state where the head of the fixing bolt 56 is inserted between the guide rings 54.

The fixing bolt 56 is connected to the fixing unit 30 by the assembly method as described above, through this connection structure, the fixing unit 30 may be configured to be assembled rotatable from the hinge shift 52 connected to the fixing bolt 56.

The connection between the fixing bolt 56 and the beam 60 is fixed by attaching a metal foot plate 70 to the lower end of the beam 60 with connecting pins 72.

The lower end of the beam 60 and the foot plate 70 are provided with a fastening groove 62 and a fastening hole 74 that are connected to each other and a fixing bolt 56 penetrates the fastening groove 62 and the fastening hole 74 for fixing, in addition, a side hole 64 is formed at a side of the beam 60 connecting with the fastening groove 62 therethrough.

The fixing bolt 56 is coupled to the beam 60 by screwing the fixing bolt 56 to the nut 58 in a state where the nut 58 is inserted into the side hole 64.

As mentioned above, the footplate 70 is a metal material and the beam is wood, and thus when fastening the fixed ball 56 to the beam 60 as shown in FIG. 7, the footplate 70 is to perform the same function as a washer.

That is, when the fixing bolt 56 is fastened to the beam 60, the beam 60 with weak durability is contracted or pushed in during the fastening process, so that the fastening depth of the fixing bolt 56 is not constant, as a result, the height of the leg part connected to the beam 60 may vary.

Even if the fastening of the fixing bolt 56 is excessively progressed, the foot plate 70 blocks this to prevent direct contraction or damage of the beam 60, which is wood.

Hereinafter, the assembly and operation of a connection device for the leg part and the beam according to the present invention is described with reference to FIGS. 1 to 9.

First, when assembling the connection device for the leg part and beam inserting the leg part 10 into the space 22 of the leg part connection frame 20 through the bottom of the leg part connection frame 20, and then, fixing the leg part 10 to the leg part connection frame 20 using a bolt 12.

Next, inserting the insertion unit 32 of the fixing unit 30 into the space 22 of the leg part connection frame 20 through the top of the leg part connection frame 20.

At this time, a second plate 36 of the insertion portion 32 and the straight portions 40 at both ends of the pressing bar 38 are in close contact with the inner surface of the space 22 of the leg part connection frame 20, and also the first plate 34 of the insertion portion 32 is hung on the upper end of the leg part connection frame 20 and limits the insertion depth of the insertion portion 32.

Securing the leg part connection frame 20 and the insertion unit 32 to each other using the bolt 24 at the above-mentioned state. At this time, inserting a metallic filler into a space between the first and second plates 34 and 36 of the insertion part 32 to facilitate fastening of the bolt 24.

Next, passing the hinge bolt 50 through a second head hole 48*a* provided in the connecting bolt 48 of the fixing unit 30, and passing the hinge shaft 52 through the third head hole 50*a*, which is formed at the end of the hinge bolt 50.

Inserting a guide ring 54 for preventing play of the hinge bolt 50 between the third head holes 50*a* of the hinge bolt 50.

In addition, passing the hinge shaft 52 through a fourth head hole 56*a* formed in a head of the fixing bolt 56 while the head of the fixing bolt 56 being inserted between the guide rings 54.

Rotating the fixing unit 30 in a left and right directions with the hinge bolt 50 as a starting point, and the fixing unit 30 allow pressing plate 46 to press and closely adhere to the outer surfaces of both sides of the beam 60 according to the folding or unfolding operation of the leg part 10.

In addition, rotating the fixing unit 30 forward and backward with the hinge shaft 52 as a starting point, and folding the leg part 10 under the beam 20, when storing the device, to reduce the volume.

The bottom of the beam 60 and the footplate 70 is connected to each other by a fastening groove 62 and a fastening hole 74, inserting the fixing bolt 56 through the fastening groove 62 and the fastening hole 74 and then inserting the nut 58 through the side hole 64 formed on the side of the beam 60 and screwing the fixing bolt 56 to the nut 58, thereby the fixing unit 30 is connected to the beam 60.

The connecting device for the leg part and the beam assembled in this way, primarily fixing the fixing unit 30 connected to the leg part 10 through the fixing bolt 56 to the beam 60, and when used in this state, unfolding the leg part 10 outwardly, rotating the pressing plate 46 of the fixing unit 30 inwardly against the hinge bolt 50 and pressing the outer surfaces of both sides of the beam 60 and the leg part 10 for firmly pressing and fixing to the beam 60.

After pressing the pressing plates 46 come into contact with the outer surfaces of both sides of the beam 60, inserting into the holes formed in the pressing plate 46 and the beam 60 using the safety pin 49, and then tightening with nuts. It allows the pressing plate 46 to maintain a press-fixed state without being separated from the beam 60 due to an impact caused by an external force.

It will be appreciated that the embodiments described above are cited by way of example, and various features thereof and combinations of these features can be varied and modified.

While various embodiments have been shown and described, it will be understood that there is no intent to limit the invention by such disclosure, but rather, it is intended to cover all modifications and alternate constructions falling within the scope of the invention, as defined in the appended claims.

EXPLANATION OF REFERENCE NUMERALS

10: a pair of leg part 20: a pair of leg part connecting frame
22: space 30: fixing unit
32: insertion part 34: first plate
36: second plate 38: pressing bar
40: both end of straight-line part 42: central round part
44: connecting bar 46: pressing plate
48: connecting bolt 50: hinge bolt
52: hinge shaft 56: fixing bolt
58: nut 60: beam
70: foot plate 80: angle control part
82: first link 84: second link
94: lift frame 96: guide bar

What is claimed is:

1. A device for connecting a pair of leg parts and a beam, the device comprising:

a pair of leg parts connection frames connected to each of the pair of leg parts;

and a fixing unit connected to the pair of leg part connection frames and pressed to both outer surfaces of the beam and connecting the pair of leg part connection frames to the beam;

wherein the fixing unit includes:

a pair of first plates hung on the upper end of the pair of the leg part connection frames, respectively;

a pair of second plates which is in close contact with an inner space of the pair of leg part connection frames in a state inserted into the space of the pair of leg part connection frames through an upper end of the pair of leg part connection frames, and is located on a lower surface of the first plate at a predetermined distance apart, respectively;

a pair of insertion parts formed in a "∩" shape configured to be inserted into the pair of inner spaces of the pair of leg part connection frames, wherein the pair of insertion parts include, a pressing bar, which is a central round part of the pressing bar exposed to the upper part of the first plate, and a straight part line part extended from the central round part thereof, positioned between the pair of the first and the pair of second plates in close contact with the inner spaces of the pair of leg part connection frames, respectively;

a pressing plate welded in contact with the central round part of the pressing bar and configured to press both sides of outer surfaces of the beam in accordance with an unfolding operation of the leg part connection frame outwardly;

a pair of connecting bolts, each of the pair of connecting bolts having a head hole, fixedly installed on a front surface and a rear surface of the pressing plate, respectively;

a hinge bolt having a head hole, configured to penetrate the head hole of the connecting bolt for a fixing unit configured to rotate in a left and a right direction;

a hinge shaft for rotating the fixing unit in forward and backward directions is installed through the head hole of the hinge bolt, and the head hole of the fixing bolt is inserted into an outer diameter of the hinge shaft; and the plurality of fixing bolts nut-fastened in a state of being inserted into a fastening groove formed at a lower end of the beam, and the fixing unit is connected to the lower end of the beam.

2. The device of claim 1, further comprising:

a foot plate made of a metal material having a higher strength than the beam, is fixed in a close contact state at the lower end of the beam in which the fastening groove is formed, a fastening hole is formed on the foot plate to communicate with the fastening groove, the fixing bolt is inserted into the fastening groove through the fastening hole.

* * * * *